US006357406B1

(12) United States Patent
Simpson

(10) Patent No.: US 6,357,406 B1
(45) Date of Patent: Mar. 19, 2002

(54) VARIABLE VALVE ACTUATION SYSTEM

(75) Inventor: Roger T. Simpson, Ithaca, NY (US)

(73) Assignee: BorgWarner Inc., Troy, MI (US)

( * ) Notice: Subject to any disclaimer, the term of this patent is extended or adjusted under 35 U.S.C. 154(b) by 0 days.

(21) Appl. No.: 09/721,112

(22) Filed: Nov. 22, 2000

(51) Int. Cl.[7] ..... F01L 1/34; F01L 13/00
(52) U.S. Cl. ..... 123/90.16; 123/90.48
(58) Field of Search ..... 123/90.12, 90.15, 123/90.16, 90.48

(56) References Cited

U.S. PATENT DOCUMENTS

| | | | | |
|---|---|---|---|---|
| 3,964,455 A | | 6/1976 | Brown | |
| 4,004,558 A | | 1/1977 | Scheibe | |
| 4,020,806 A | | 5/1977 | Aoyama et al. | |
| 4,151,817 A | | 5/1979 | Mueller | |
| 4,205,634 A | * | 6/1980 | Tourtelot, Jr. | 123/90.15 |
| 4,394,851 A | * | 7/1983 | Greier et al. | 123/182.1 |
| 4,438,736 A | | 3/1984 | Hara et al. | |
| 4,836,155 A | | 6/1989 | Singley et al. | |
| 4,942,854 A | | 7/1990 | Shirai et al. | |
| 4,986,227 A | | 1/1991 | Dewey, III | |
| 5,099,805 A | * | 3/1992 | Ingalls | 123/90.15 |
| 5,113,813 A | | 5/1992 | Rosa | |
| 5,386,806 A | | 2/1995 | Allen et al. | |
| 5,524,580 A | | 6/1996 | Muir | |
| 5,564,373 A | * | 10/1996 | Hara | 123/90.16 |
| 5,931,125 A | * | 8/1999 | Valasopoulos | 123/90.16 |
| 5,975,036 A | | 11/1999 | Hayashi et al. | |

* cited by examiner

*Primary Examiner*—Wellun Lo
(74) *Attorney, Agent, or Firm*—Emch, Schaffer, Schaub & Porcello Co., L.P.A.; Greg Dziegielewski

(57) ABSTRACT

A variable valve actuation (VVA) system (10/210) includes a camshaft (20), having a lobe (22) thereon. A valve (30/230) terminates in a stem end (34/234), and is moveable between open and closed positions along its own longitudinal axis, where the valve is biased toward the closed position. A bucket tappet (40/240) includes a lifter plate (41/241) having a middle portion (44/244) for engaging the lobe of the camshaft on a camshaft side (46/246) of the lifter plate, and for engaging the stem end of the valve on a valve side (48/248) of the lifter plate. The lifter plate includes end portions (50/250/252) on either side of the middle portion, and is translatable by rotation of the lobe of the camshaft to cause movement of the valve along its longitudinal axis toward the open position. Finally, a pivoting device (70/72/80/270) is in engagement with at least one of the end portions of the lifter plate, for pivoting the lifter plate toward the lobe for early engagement therewith, and for pivoting the lifter plate away from the lobe for delayed engagement therewith. The early engagement causes the valve to open prematurely, and the delayed engagement causes the valve to open belatedly.

10 Claims, 2 Drawing Sheets

VARIABLE VALVE ACTUATION SYSTEM

BACKGROUND OF THE INVENTION

1. Field of the Invention

The present invention generally relates to variable valve actuation devices for use with internal combustion engines. More specifically, this invention relates to a novel architecture for a lifter plate arrangement used in varying valve timing of an overhead camshaft engine.

2. Description of the Prior Art

Conventionally, valve trains of internal combustion engines include poppet valves that are spring loaded toward a valve-closed position. The poppet valves are biased open by a lifter plate or tappet interposed each poppet valve and an overhead camshaft mechanism, or a camshaft and push rod mechanism. In either case, the camshaft is connected to and rotates in synchronization with an engine crankshaft to open and close each valve at predetermined intervals as defined by the position of lobes on the camshaft. Therefore, the sequence and lift distance of each valve is fixed by the predetermined relationship between the lifter plate and the lobes on the camshaft.

Such direct-drive arrangements fix valve train operation and thereby limit engine performance because ideal valve timing varies—and is not fixed—over the full range of engine speed. Therefore, it would be desirable to incorporate a variable drive arrangement in which the valve train is not fixed, but is independently variable with respect to each valve. In other words, valve lift distance and timing could be varied independently for each valve. These factors can be varied to improve breathing of the engine to increase performance, fuel economy, or emissions.

Consequently, what is needed is a variable valve actuation system that packages tightly within an engine and permits independent variability of the timing of each valve.

SUMMARY OF THE INVENTION

According to the present invention, there is provided a variable valve actuation (VVA) system. The VVA system is used in conjunction with an overhead camshaft that has a series of camshaft lobes thereon. An engine valve terminates in a stem end and is moveable between open and closed positions along its own longitudinal axis, where the valve is biased toward the closed position. A bucket tappet includes a lifter plate that has a middle portion for engaging the lobe of the camshaft on a lobe side of the lifter plate and for engaging the stem end of the valve on a valve side of the lifter plate. The lifter plate includes end portions on either side of the middle portion, and is translatable by rotation of the lobe of the camshaft to cause movement of the valve along its longitudinal axis toward the open position. Finally, a pivoting device is in engagement with at least one of the end portions of the lifter plate, for pivoting the lifter plate toward the lobe for early engagement therewith and for pivoting the lifter plate away from the lobe for delayed engagement therewith. The early engagement causes the valve to open prematurely and the delayed engagement causes the valve to open belatedly.

Accordingly, it is an object of the present invention to provide a VVA system that is capable of both varying the timing of the valve opening and closing, and varying the duration of the opening of the valve.

It is another object of the present invention to provide a VVA system that packages tightly, if not symmetrically, around a valve stem of a valve.

It is yet another object to provide a VVA system that incorporates a bucket tappet having a variable angle lifter plate disposed between a camshaft lobe and a valve.

These objects and other features, aspects, and advantages of this invention will be more apparent after a reading of the following detailed description, appended claims, and accompanying drawings.

DETAILED DESCRIPTION OF THE PREFERRED EMBODIMENT

In general, a variable valve actuation system is provided for varying the timing and lift of the intake and exhaust valves of an engine. Variable valve actuation strategies and related hardware, such as hydraulic actuators and solenoids, are well developed and known in the art and therefore will not be discussed or reproduced here. Rather, the present invention introduces new architecture for placement between an overhead camshaft and valve and will be the focus of this description. Furthermore, the term valve lifter may be considered synonymous with rocker arm or tappet.

Figure 1:
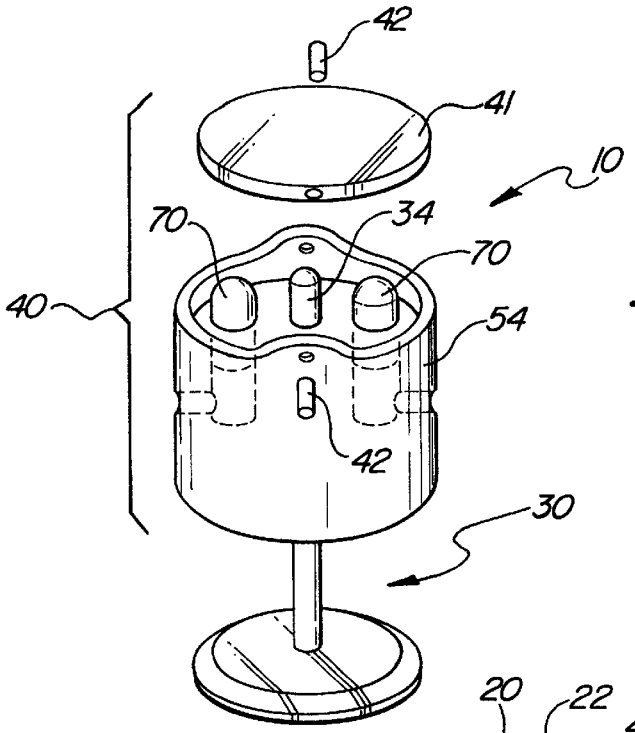
FIG. 1 is a partially exploded perspective view of a bucket tappet and valve of a variable valve actuation system for an internal combustion engine according to the present invention.

Referring now specifically to the Figures, there is shown in FIG. 1 a portion of a variable valve actuation (VVA) system 10 according to the preferred embodiment of the present invention is shown including a valve 30 inserted within a bucket tappet 40. The bucket tappet 40 includes a lifter plate 41 hinged to a bucket 45 by hinge pins 42 on opposite sides of the bucket 45. An opposed pair of hydraulic actuators 70 are moveably disposed within the bucket 45 for pivoting the lifter plate 41 about the hinge pins 42. Finally, a valve 30 extends upwardly through the bucket 45 and terminates in a stem end 34 that is biased against an underside of the lifter plate 41 by a spring (not shown).

Figure 2:
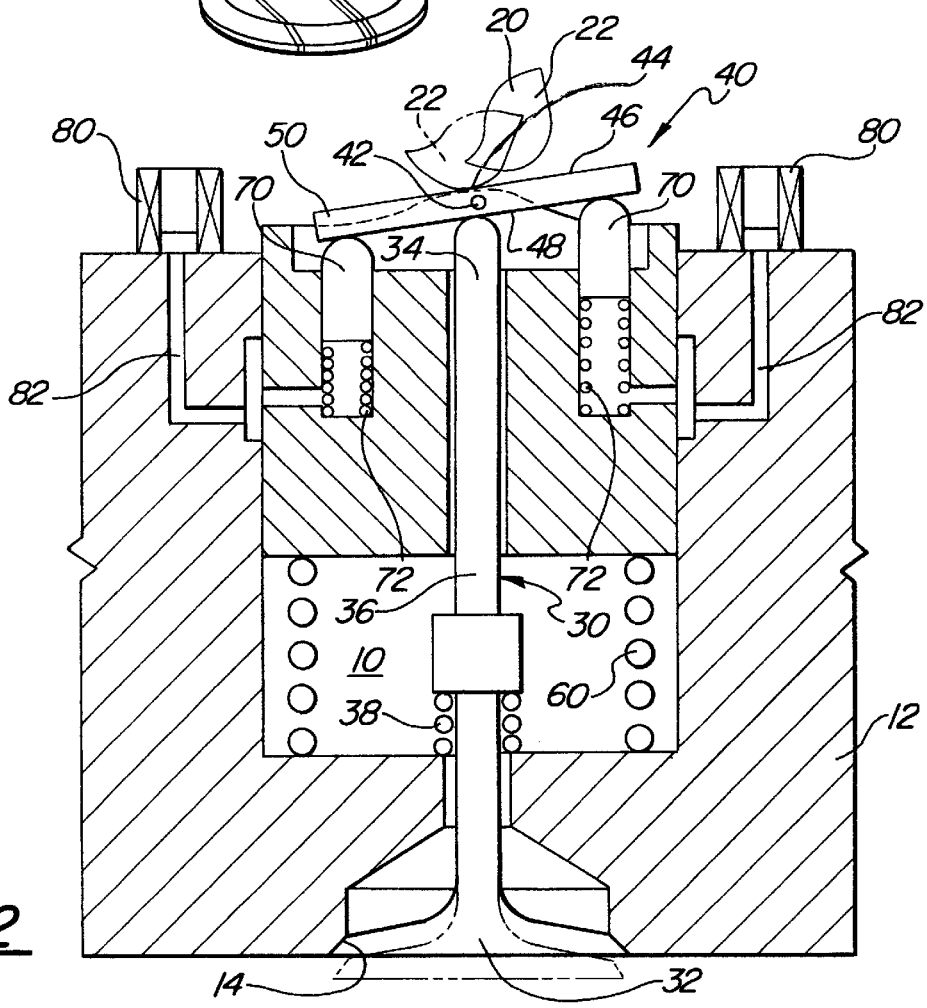
FIG. 2 is a partial cross-sectional view of the variable valve actuation system of FIG. 1.

Referring now to FIG. 2, the VVA system 10 includes a camshaft 20 having one or more lobes 22 for controlling the valve 30 via the interposition of the bucket tappet 40 therebetween. The bucket tappet 40 is moveably disposed within a tappet bore 16 of a cylinder head 12. The lifter plate 41 is pivotable on the hinge pins 42 that are parallel to the rotation of axis of the camshaft 20. A head 32 of the valve 30 rests against a valve seat 14 of a cylinder head 12, and functions to open and close an opening in the cylinder head 12 to permit fuel and air to flow through the cylinder head 12, or to permit spent products of combustion to flow from the cylinder head 12. The valve 30 is resiliently biased toward its cylinder-closed position in constant contact with the lobe 22 by a valve spring 38 and bucket spring 60.

The lifter plate 41 includes a middle portion 44 that engages with the lobe 22 of the camshaft 20 on a camshaft side 46 of the lifter plate 41. The middle portion 44 is further pivotably connected to a stem end 34 of a valve stem 36 of the valve 30 by the hinge pin 42, on a valve side 48 of the lifter plate 41. The lifter plate 41 further includes an end portion 50 on either side of the middle portion 44 for engaging hydraulic actuators 70 on the valve side 48 of the lifter plate 41. Each hydraulic actuator 70 includes a spring 72 for biasing the lifter plate 41 to a level baseline position. It is anticipated that any other reasonable arrangement for engaging the hydraulic actuators 70 to the end portions 50 of the lifter plate 41 could be alternatively used. A solenoid 80 controls flow of hydraulic fluid, namely engine lubricating oil, to each hydraulic actuator 70 through oil passages 82 in the cylinder head 12 as is well known in the art. The solenoids 80 are in turn controlled by an electronic engine control unit (not shown) for controlling the timing and amount of oil supplied to the hydraulic actuators 70. Additionally, alternative lifter plates could be used that incorporate predefined contours on the camshaft side 46 of the lifter plate 41 for varied valve timing and operation.

In operation, the VVA system 10 is capable of advancing or retarding the valve timing or duration of opening. The valve 30 is caused to reciprocate along its longitudinal axis along its stem 36, by the rotation of the camshaft 20, which is caused to rotate by a chain or belt drive from an engine crankshaft in a known manner (by elements not shown). The lobe 22 of the camshaft 20 thus rotates and acts upon the lifter plate 41 in a downward fashion. When the lifter plate 41 is in its baseline position, the valve 30 opens and closes "on time". The baseline position of the VVA system is where the lifter plate 41 is horizontal, and perpendicular relative to the axis of the valve stem 36. As shown, the lifter plate 41 is lifted by the hydraulic actuator 70 to an advanced position so that the valve 30 opens and closes "early". Accordingly, the lobe 22 is shown in solid line as it rotates counter-clockwise and initially engages the lifter plate 41 in the advanced position. Additionally, the lobe 22 is shown in phantom line as it would be in a valve-open position, and likewise, the head 32 of the valve 30 is shown in phantom line in the valve open position. Alternatively, the lifter plate 41 may be pivoted to a retarded position by the other hydraulic actuator 70 so that the valve 30 opens and closes "late". It is contemplated that the hydraulic actuators 70 are capable of articulating the lifter plate 41 by at least +/−10°. In this way the opening of the valve 30 can be regulated, and the duration of its open period changed, as required or desired to achieve improved engine operating conditions.

Figure 3:
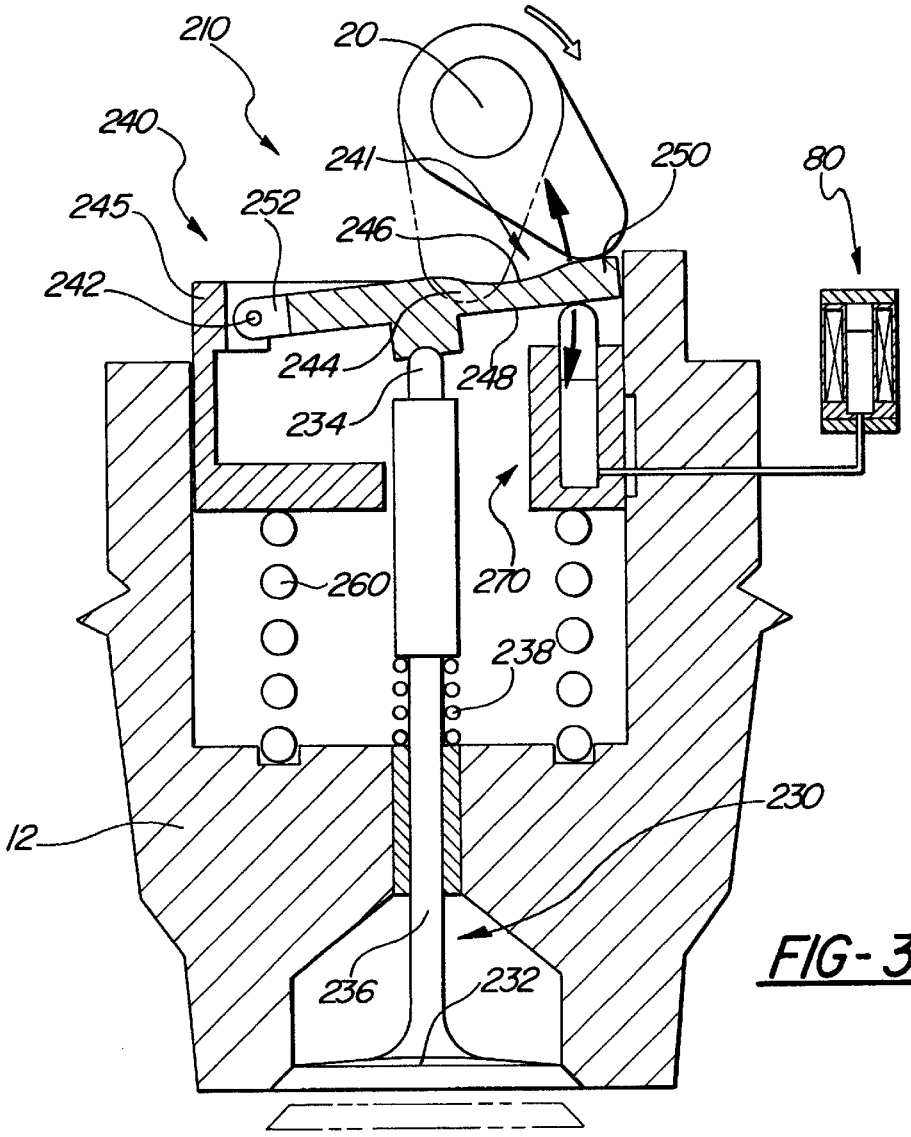
FIG. 3 is a partial cross-sectional view of another variable valve actuation system according to the present invention.
Figure 4:
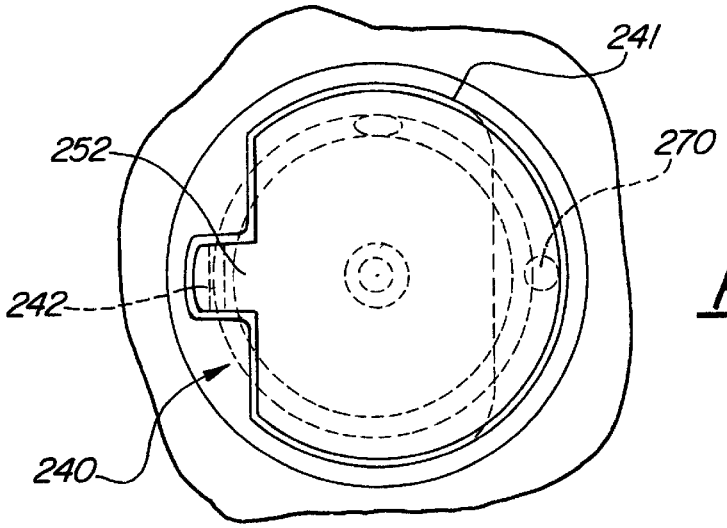
FIG. 4 is a top view of the variable valve actuation system of FIG. 3, not showing the camshaft thereof.

FIG. 3 illustrates an alternative embodiment of a variable valve actuation system 210 in which a bucket tappet 240 is interposed the camshaft 20 and a valve 230. Referring to FIGS. 3 and 4, the bucket tappet 240 includes a lifter plate 241 having a hinge end portion 252 that is hinged to a bucket 245 by a hinge pin 242 on one side of the bucket 245. The lobe 22 of the camshaft 20 is in constant engagement with a camshaft side 246 of the lifter plate 241. A middle portion 244 of the lifter plate 241 is in constant engagement with a stem end 234 of the valve 230 on a valve side 248 of the lifter plate 241.

An hydraulic actuator 270 is integrated into the bucket 245 on the right side thereof. The hydraulic actuator 270 operates on an actuator end portion 250 of the lifter plate 241 on a valve side 248 of the lifter plate 241. As before, a solenoid 80 controls operation of the hydraulic actuator 270 in response to commands from an electronic engine control unit (not shown). Finally, and as with the preferred embodiment, a bucket spring 260 biases the bucket tappet 240 into constant contact with the camshaft 20. Similarly, a valve spring 238 biases the valve 230 into constant contact with the bucket tappet 240.

Accordingly, operation of the bucket tappet 240 is similar to that of FIG. 1. When the lifter plate 241 is in its baseline position, the valve 230 opens and closes "on time". The baseline position of the VVA system is where the lifter plate 241 is horizontal, and perpendicular relative to the longitudinal axis of a valve stem 236. As shown, the lifter plate 241 is lifted by the hydraulic actuator 270 to an advanced position so that the valve 230 opens and closes "early". Accordingly, the lobe 22 is shown in solid line as it rotates clockwise and initially engages the lifter plate 241 in the advanced position. Additionally, the lobe 22 is shown in phantom line as it would be in a valve-open position, and likewise, a head 232 of the valve 230 is shown in phantom line in the valve open position. Alternatively, the lifter plate 241 may be pivoted to a retarded position by deactivating the hydraulic actuator 270 so that the actuator end portion 250 of the lifter plate 241 drops below level. Accordingly, the lobe 22 would not engage the actuator end portion 250 of the lifter plate 241 but would instead engage the lifter plate 241 somewhere in the middle portion 244 thereof to cause the valve 230 to open and close "late". It is contemplated that the hydraulic actuator 270 is capable of articulating the lifter plate 241 by at least +/−10°.

From the above, it can be appreciated that a significant advantage of the present invention is that the variable valve actuation system packages tightly around a valve, and is capable of independently operating each valve within an engine to provide for advanced or retarded timing and modified duration of valve opening.

While the present invention has been described in teems of a preferred embodiment, it is apparent that other forms could be adopted by one skilled in the art. For example, the present invention could be employed for disengaging the valve from the camshaft for at least some portion of an engine cycle by dropping the lifter plate out of engagement with the cam lobe. Additionally, one solenoid could be used to control a plurality or all of the lifter plates of a single engine. Accordingly, the scope of the present invention is to be limited only by the following claims.

What is claimed is:

1. A variable valve actuation system (10/210) comprising:

a camshaft (20) having a lobe (22) thereon;

a valve (30/230) terminating in a stem end (34/234) and moveable between open and closed positions along its longitudinal axis, said valve being biased toward said closed position;

a bucket tappet (40/240) having a lifter plate (41/241), said lifter plate having a middle portion (44/244) for engaging said lobe of said camshaft on a camshaft side (46/246) of said lifter plate, and for engaging said stem end of said valve on a valve side (48/248) of said lifter plate, said lifter plate having end portions (50/250/252) on either side of said middle portion, said lifter plate being translatable by rotation of said lobe of said camshaft to cause movement of said valve along its longitudinal axis toward said open position; and pivoting means (70/72/80/270), in engagement with at least one of said end portions of said lifter plate, for pivoting said lifter plate toward said lobe for early engagement therewith and for pivoting said lifter plate away from said lobe for delayed engagement therewith, whereby said early engagement causes said valve to open prematurely and said delayed engagement causes said valve to open belatedly.

2. The variable valve actuation system as claimed in claim 1, wherein said pivoting means comprises at least one hydraulic actuator (70/270).

3. The variable valve actuation system as claimed in claim 2, wherein said at least one hydraulic actuator is capable of pivoting said lifter plate plus or minus approximately ten degrees.

4. A variable valve actuation system (10) for actuating a valve (30) in cooperation with a lobe (22) of a camshaft (20), said variable valve actuation system comprising:

a bucket tappet (40) having a lifter plate (41) with a middle portion (44) in engagement with said lobe on a camshaft side (46) of said lifter plate, said middle portion further being pivotably connected with said valve on a valve side (48) of said lifter plate, said lifter plate having end portions (50) on either side of said middle portion; and pivoting means (70/72/80), in engagement with said end portions on said valve side of said lifter plate, for pivoting said lifter plate in one direction for advanced engagement with said lobe, and in an opposite direction for delayed engagement with said lobe.

5. The variable valve actuation system as claimed in claim 4, wherein said pivoting means comprises two hydraulic actuators (70) one each in engagement with a respective one of said end portions of said lifter plate.

6. The variable valve actuation system as claimed in claim 4, wherein said lifter plate takes the form of a substantially flat plate that is hinged to said tappet.

7. A variable valve actuation system (210) for actuating a valve (230) in cooperation with a lobe (22) of a camshaft (20), said variable valve actuation system comprising:

a bucket tappet (240) including:

a bucket (245);

a lifter plate (241), having a middle portion (244) in engagement with said lobe on a camshaft side (246) of said lifter plate, said middle portion further in engagement with said valve on a valve side (248) of said lifter plate, said lifter plate having a hinge end portion (252) hinged to said bucket and an actuator end portion (250) opposite said hinge end portion; and pivoting means (80/270), in engagement with said actuator end portion on said valve side of said lifter plate, for pivoting said lifter plate in one direction for advanced engagement with said lobe and in an opposite direction for delayed engagement with said lobe.

8. The variable valve actuation system as claimed in claim 7, wherein said lifter plate (241) includes a predetermined contoured surface on said camshaft side of said lifter plate.

9. The variable valve actuation system as claimed in claim 7, wherein said bucket tappet includes a hinge pin (242) hinged to said hinge end portion of said lifter plate and further includes an hydraulic actuator (270) integral with said bucket substantially opposite said hinge portion, wherein said hinge pin is attached to said bucket tappet.

10. The variable valve actuation system as claimed in claim 9, wherein said hydraulic actuator is collapsed for delayed engagement with said lobe, and is extended for advanced engagement with said lobe.

* * * * *